US007036168B1

(12) United States Patent
Knickerbocker

(10) Patent No.: US 7,036,168 B1
(45) Date of Patent: May 2, 2006

(54) PORTABLE HEADREST

(76) Inventor: Kristin Knickerbocker, 3266 Eureka Pl., Carlsbad, CA (US) 92008

( * ) Notice: Subject to any disclaimer, the term of this patent is extended or adjusted under 35 U.S.C. 154(b) by 0 days.

(21) Appl. No.: 10/851,244

(22) Filed: May 24, 2004

(51) Int. Cl.
*A47C 20/12* (2006.01)

(52) U.S. Cl. ..... 5/640; 5/638; 5/636

(58) Field of Classification Search ..... 5/636–638, 5/640, 643, 725
See application file for complete search history.

(56) References Cited

U.S. PATENT DOCUMENTS

| | | | | |
|---|---|---|---|---|
| 3,005,212 | A * | 10/1961 | Barnhill | 5/646 |
| 3,114,527 | A * | 12/1963 | Demarest | 5/638 |
| 4,881,728 | A | 11/1989 | Hunter | |
| 5,177,823 | A | 1/1993 | Riach | |
| 5,408,713 | A | 4/1995 | Stratton et al. | |
| 5,661,860 | A * | 9/1997 | Heitz | 5/638 |
| 6,049,926 | A | 4/2000 | Amaral | |
| 6,148,460 | A | 11/2000 | Fried et al. | |
| 6,151,734 | A | 11/2000 | Lawrie | |
| 6,276,012 | B1 | 8/2001 | Borders | |
| 6,397,414 | B1 | 6/2002 | Lloyd | |
| 6,408,465 | B1 | 6/2002 | Fleming | |

* cited by examiner

*Primary Examiner*—Frederick L. Lagman
(74) *Attorney, Agent, or Firm*—James Creighton Wray

(57) ABSTRACT

A collapsible portable headrest extends from a bed. A base fits between the mattress and box spring of a bed. An outer end of the base is connected by hinged clamps to lower ends of legs. Upper ends of legs are connected by locking hinges to inner ends of a headrest top. An opening or space for breathing is provided in cushions or a cushion on the top. Telescoping tubes with clamps adjust to mattress thickness and compact storage requirements. Clamping or locking hinges at the joints allow folding the elements flat for carrying or storing. The user rests on the bed and slides forward, resting the head with the nose in the middle of the curved horseshoe-shaped padded headrest. This position makes it possible for a masseur to massage the back while standing beside or in front of the prone subject.

16 Claims, 3 Drawing Sheets

PORTABLE HEADREST

BACKGROUND OF THE INVENTION

Portable massage tables are known that can be carried into persons' homes or offices for massage. Portable tables are heavy and awkward to carry and are not suited for ease in transportation.

When stiff beds and mattresses are available in homes, they provide a suitable platform for massage. However, it is necessary to twist the neck to keep persons' airways open. The twisting of a neck interferes with work on muscles, tendons and vertebrae, and makes a massage less effective or, in some cases, may cause pain or discomfort in the upper body.

A straight back and neck are desirable.

Bed attachments have been provided. However, the attachments are cumbersome and difficult to store or carry.

Needs exist for bed-attached head and neck supports that make beds into suitable massage platforms and which are easy to store and carry.

SUMMARY OF THE INVENTION

A preferred headrest apparatus for a bed has a plate or base for placing between a mattress and a mattress support with an outer end of the plate projecting beyond an edge of the mattress. First hinges are connected to the outer end of the plate. Upright supports are connected to the first hinges for standing upward along a wall of a mattress in an operational position and for lying parallel with the plate in a stored position. Second hinges are connected to an upper end of the upright support. A head support extends outward from the second hinges for extending outward from an upper surface of the mattress in an operational position and for lying parallel with the upright supports in a stored position.

The first and second hinges have first spaced apart pins and second spaced apart pins respectively connected to spaced apart members on the plate and the upright support, and connected to spaced apart members of the upright support and the head support.

The pins have clamps. The base, the members of the upright support and the members of the head support have interlocking structures for permitting pivoting while the clamps are loosened, and preventing pivoting when the clamps are tightened.

The base has a lightweight plate with weight-reducing cutouts and a handle. The outer end has locking hinges connected to lower ends of the upright support arms.

The spaced apart members of the upright support have extensible tubes connected by the hinges to the outer end of the plate and are foldable parallel to the plate in stored position, and extend normally to the plate in working position.

The head support has a padded circle connected to upper ends of the vertical members of the upright support. The head support is foldable along the spaced apart members of the upright support in the stored position.

A preferred method of providing a head support outward from a mattress of a bed comprises unfolding an upright support around first hinges connected between the upright support and a horizontal support plate from a stored position parallel to the support plate. The upright support and support plate are locked in a first operational position. A head support is unfolded around second hinges connected to a top of the upright support. The head support is locked in a second operational position. The horizontal support plate is slid under an edge of a mattress until the upright support engages a wall of the mattress.

The support plate is slid outward from beneath the mattress. The head support and the upright supports are unlocked and folded around the second hinges, which are relocked in the folded position. The upright supports and the support plate are unlocked, folded around the first hinges and relocked. The head support, the telescoped upright supports and the support frame are stored in parallel relationship.

A collapsible portable headrest extends from a bed. A base support fits between the mattress and box spring of a bed. Outer ends of the base are connected to lower ends of vertical legs. Upper ends of legs are connected to of inner ends of the top. An opening or space for breathing is provided in cushions or a cushion at the top. Clamps at the joints allow folding the elements flat for carrying or storing. The user rests on the bed and slides forward, resting the head with the nose in the U of the horseshoe-shaped padded headrest. This position makes it possible for a masseur to massage the back while standing in front of or alongside the prone subject.

A portable headrest for a bed has an under mattress base is a plate or frame with spaced parallel elongated beams interconnected by cross beams. The spaced parallel elongated beams have outer ends extending from between a mattress and a support structure for the mattress. Spaced upright telescoping tubes or beams have upper ends and lower ends. The lower ends are connected to the front ends of the base. First interconnectors between the lower end of the upright beams and the outer ends of the base rigidly hold the beams in predetermined normal relative positions for working, and in collapsed parallel positions for storage and carrying. A head support has inner ends connected to the upper ends of the spaced upright beams. Second interconnectors between the upper ends of the upright beams and the inner ends of the head support rigidly hold the head support in predetermined normal relative working positions with the upright beams, and in collapsed parallel positions for storage and carrying. A padded headrest is connected to the head support for resting a head of a user on the headrest away from the mattress.

The upright beams are adjustable vertically. In one embodiment, the outer ends of the spaced parallel elongated beams are positioned outward of the lower ends of the upright beams. The inner ends of the spaced head support beams are positioned inward of the upper ends of the upright beams. The elongated, upright and head support beams comprise pairs of elongated, upright and head support beams. The ends of the beams have interengaging connections.

The first and second interconnectors further have threaded bolts extending through the ends of the beams. Nuts are connected to the bolts and the beams. Complementary interlocking faces between the beams lock the beams in selected relative normal positions for working or collapsed positions for storing and carrying.

The first and second interconnectors respectively have first complementary connections and pivots on the inner ends of the elongated beams and the lower ends of the upright beams, and second complementary connections and pivots on the upper ends of the upright beams and the inner ends of the head support beams.

The connections are rounded, rectangular or elongated, and the pivots in the first connection are offset inward from the lower ends of the upright beams. The pivots in the second connections are offset outward from the upper ends of the upright beams for folding the upright beams on the elongated beams and folding the head support beams on the upright beams.

The pivots in the first connection are offset inward from the lower ends of the upright beams. The pivots in the second connections permit folding the head support beams within the upright beams.

The locking and unlocking have tightening and loosening bolts for engaging and disengaging interengaging locking surfaces.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
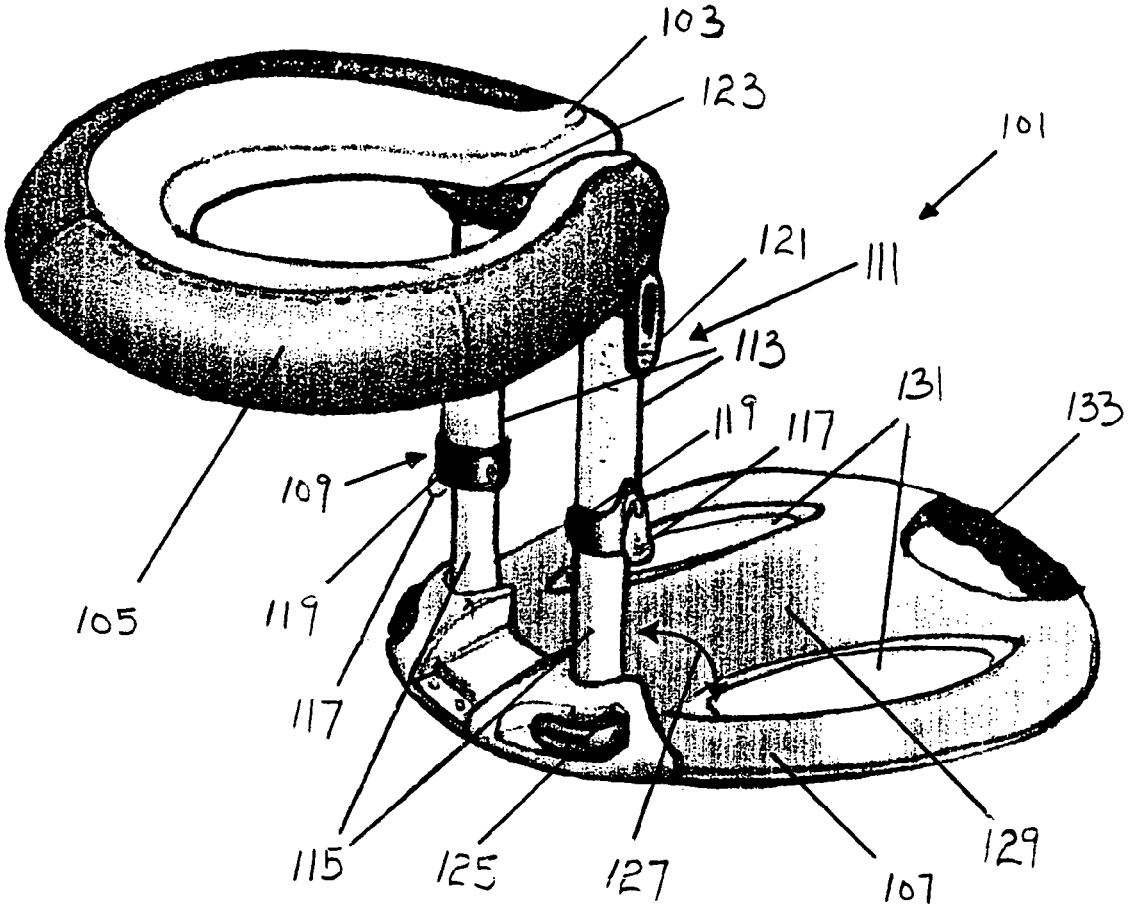
FIG. 1 is a perspective view of a portable headrest and support frame of the invention for mounting beneath and along a side or end wall of a mattress.
Figure 2:
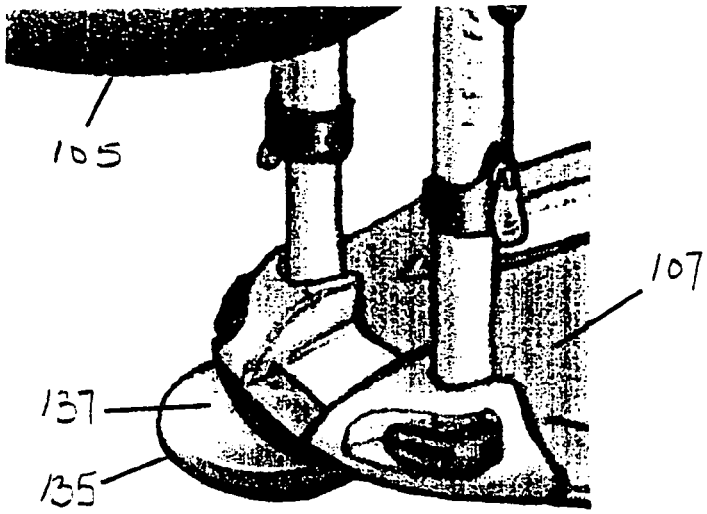
FIG. 2 is a perspective view of a detail of a removable aroma therapy oil tray on the portable headrest shown in FIG. 1.
Figure 3:
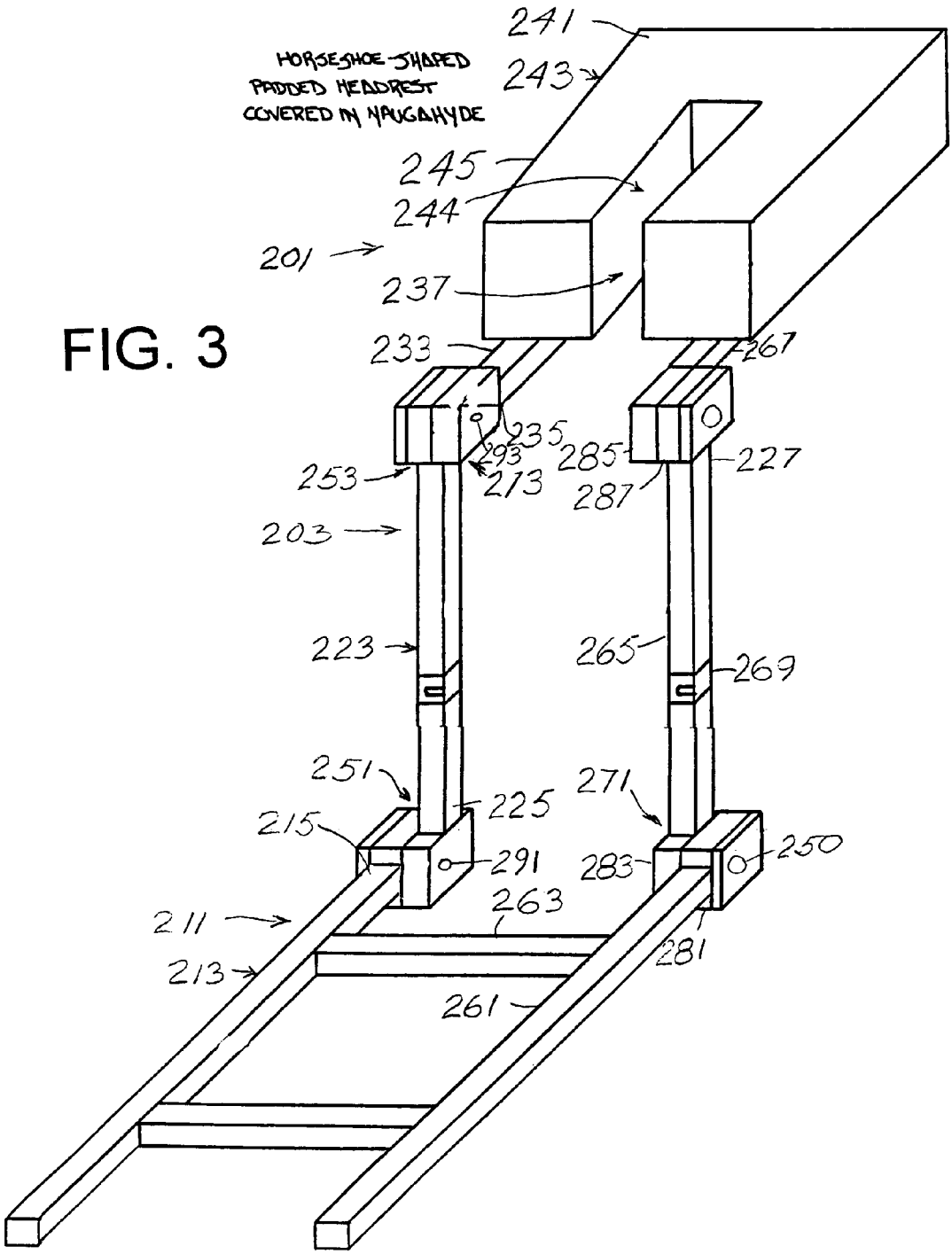
FIG. 3 is a perspective view of an alternate embodiment of the portable headrest of the invention.

A preferred embodiment of the invention is shown in FIGS. 1 and 2. The new portable headrest 101 has locking hinges at ends of locking telescoping vertical supports, and the base has a rounded form. The entire headrest and support may be collapsed and folded into a flat unit that can be stored and carried in a case that is similar to a shoulder bag or briefcase. The headrest 103 is rounded and ergonomically designed to conform to the user's forehead and cheeks. The headrest 103 is made of contour memory foam padding or a similar substance for greater comfort. The headrest 103 may have an optional washable headrest bonnet or cover 105. Alternatively or in addition, an impermeable paper-faced cover may be laid across the headrest.

The headrest section 103 is connected to base section 107 by tubular, parallel telescoping supports 109, 111. The supports 109, 111 are made of metal, plastic or a similar material and are fully adjustable in height. The supports 109, 111 are made of two sections 113, 115 that slide relative to one another for adjusting height. The telescoping sections 113, 115 of the supports 109, 111 are locked into the desired position by clamps 119 with locking levers 117. Telescoping section clamps 119 are closed and released by the locking levers 117.

Quick release levers 121 are located at the tops of the parallel supports 109, 111 for simple heat rest 103 adjustment and folding. The headrest 103 is attached to the parallel supports 109, 111 by hinges 123. The lower ends 115 of the parallel supports 109, 111 are connected to the base by locking hinges and are perpendicularly connected to the base 107 when the portable headrest 101 is erected for use. To close the headrest 101, quick release clamps 121 and 125 are released, and the parallel supports 109, 111 are pushed 127 toward the flat surface 129 of the base 107. The base 107 may be made of lightweight stamped metal. The base 107 may also have cutouts 131 and a padded handle 133 for convenient portability.

FIG. 2 shows a detail of the headrest 101 with an optional, removable aroma therapy oil tray 135. The tray 135 attaches to the base 107 and has a depression 137 that holds aroma therapy oils under the user's face.

A collapsible portable headrest is made from hinged elements. A base extends from a bed. A support base fits between a mattress and a box spring of a bed. Outer ends of the base are connected by locking hinges to lower ends of legs. Upper ends of legs are connected to a curved U-shaped top. An opening or space for breathing is provided in cushions or a curved U-shaped cushion on the top. Clamps at the joints allow folding the elements flat for carrying or storing. A user rests face down on the bed, resting his forehead on top of the cushion with his nose and mouth in the opening between sides of the horseshoe-shaped padded headrest cushion. That position makes it possible for a masseur to massage a user's back while standing along or in front of the prone user.

In the portable headrest assembly, an under mattress base, has a plate with an integral carrying handle. The plate has outer ends extending from between a mattress and a support structure for the mattress. Tubular telescoping legs are formed as spaced uprights having upper ends and lower ends. The lower ends are connected to the front outer end of the base. First hinge interconnectors between the lower ends of the uprights and the outer end of the base rigidly hold the parts in predetermined normal relative positions for working, and in collapsed parallel positions for storage and carrying. The frame top has a head support with inner ends connected to the upper ends of the spaced uprights by second hinge interconnectors to rigidly hold the head support in predetermined normal relative working positions with the upright beams 65, and in collapsed parallel positions for storage and carrying. A padded headrest is connected to the head support for resting a head of a user on the headrest away from the mattress.

The uprights are adjustable vertically 69.

A collapsible portable headrest 201 made from elements 203 extends from a bed. A box-shaped or tubular frame 211 has a support base 213 that fits between a mattress and a box spring of a bed. Outer ends 215 of the base 213 are positioned outside of lower ends 225 of legs 223. Upper ends 227 of legs 223 are positioned outside of inner ends 235 of the tj-shaped frame top 233. An opening 237 or space for breathing is provided in cushions or a U-shaped cushion 243 on the frame top 233. Screw-type clamps 250 at the joints 251, 253 allow folding the elements 223 flat for carrying or storing. A user rests face down on the bed, resting his forehead on the top 241 of cushion 243 with his nose and mouth in the opening 244 between sides 245 of the horseshoe-shaped padded headrest cushion 243. That position makes it possible for a masseur to massage a user's back while standing in front of the forward prone user.

In the portable headrest assembly 221, an under mattress frame base 213 has spaced parallel elongated beams 261 interconnected by cross beams 263. The spaced parallel elongated beams 61 have outer ends 215 extending from between a mattress and a support structure for the mattress. The legs 223 are formed as spaced upright beams having upper ends 227 and lower ends 225. The lower ends 225 are connected to the front outer ends 215 of the elongated base beams 261. First interconnectors 271 between the lower ends 225 of the upright beams 265 and the outer ends 215 of the elongated beams rigidly hold the beams in predetermined normal relative positions for working, and in collapsed parallel positions for storage and carrying. The frame top 233 has spaced head support beams 267 which have inner ends 235 connected to the upper ends 227 of the spaced upright beams 265. Second interconnectors 273 between the upper ends 227 of the upright beams 265 and the inner ends 235 of the head support beams 267 rigidly hold the head support beams 267 in predetermined normal relative working positions with the upright beams 265, and in collapsed parallel positions for storage and carrying. A padded headrest 243 is connected to the head support beams 267 for resting a head of a user on the headrest away from the mattress.

The upright beams 265 are adjustable vertically 269.

The outer ends 215 of the spaced parallel elongated beams 261 are fixed in connections 281 positioned outward of connections 83 which hold the lower ends 225 of the upright beams 265.

The inner ends 235 of the spaced head support beams 267 are fixed in connections 285 positioned inward of connections 287 in which the upper ends 227 of the upright beams 265 are fixed.

The elongated, upright and head support beams comprise pairs of elongated, upright and head support beams.

The ends of the beams have fixed in the interengaging connections 281, 283, 285, 287.

The first and second interconnectors further have threaded bolts extending through the ends of the beams. Nuts are connected to the bolts and the beams. Complementary interlocking faces between the beams lock the beams in selected relative normal positions for working or collapsed positions for storing and carrying.

The first and second interconnectors 271, 273 respectively have first complementary connections 281, 283 and pivots 291 on the outer ends 215 of the elongated beams 261 and the lower ends 225 of the upright beams 265, and second complementary connections 287, 285 and pivots 293 on the upper ends 227 of the upright beams 265 and the inner ends 235 of the head support beams 267.

The connections 283 are rounded, rectangular or elongated, and the pivots 291 in the connections 283 are offset inward from the lower ends 225 of the upright beams 265. The pivots 291, 293 in the connections 281, 283, 285, 287 provide for folding the upright beams 265 on the cross beams 263 between the elongated beams 261 and folding the head support beams 267 between the upright beams 265.

The first and second hinges 291, 293 have bolts 295 and connections 281, 283, 285, 287. The members of the frame, the members of the upright support and the members of the head support have interlocking structures for permitting pivoting while the bolts and nuts are loosened, and preventing pivoting when the bolts and nuts are tightened.

Figure 4:
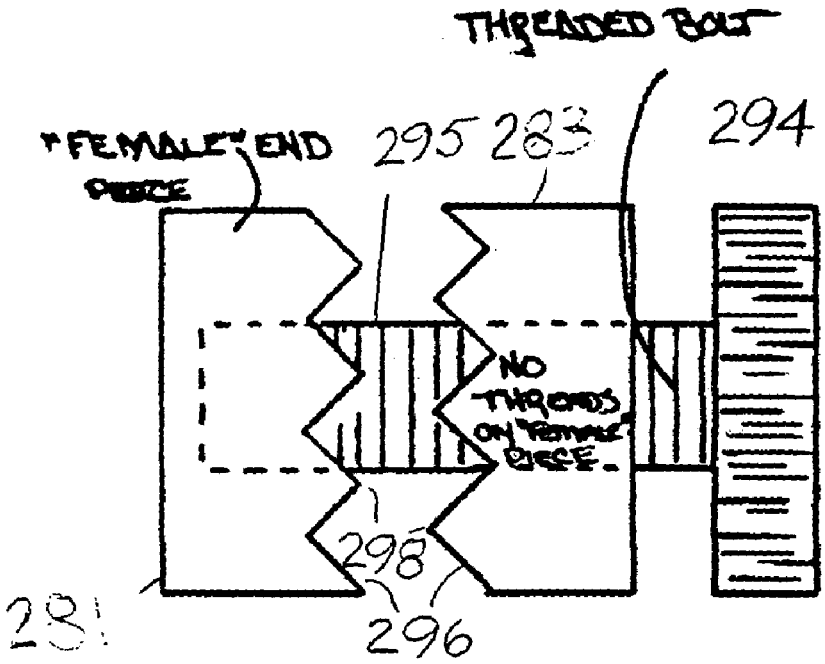
FIG. 4 shows a locking hinge detail for the portable headrest.
Figure 5:
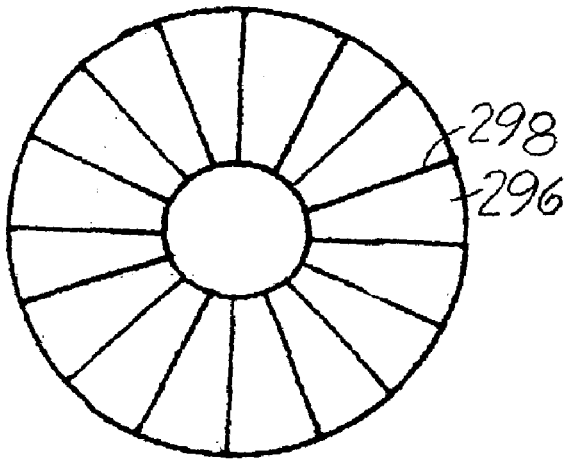
FIG. 5 shows possible formations of facial opposite interengaging teeth in a locking hinge.

In one form, as shown in FIGS. 4 and 5, the bolts 295 are rotationally mounted and axially held in a connection 281. Connection 283 moves along the bolt 295 as the large knurled head 94 is turned. Faces 296 with teeth 298 engage in the locked position. Interengaging connections 281, 283, 285, 287 are tightly fixed in this manner.

Alternatively, tightening and loosening bolts engage and disengage surface patterns on the connections or joints 251, 253.

An alternate method of providing a head support outward from a mattress of a bed includes unfolding an upright support assembly 201 around first hinges 291 connected between the upright support 223 and a horizontal support frame 213 from a stored position parallel to the support frame. The upright support and support frame are locked in a first operational position. A head support frame 233 is unfolded around second hinges 293 connected to tops of the upright support 223. The head support 233 is locked in an operational position. The horizontal support frame 213 is slid under an edge of a mattress until the upright support 223 engages a wall of the mattress.

To store or carry the assembly, the support frame 213 is slid outward from beneath a bed. The head support 233 and the upright support 223 are unlocked and folded around the second hinges 293. The upright support 223 and the support frame 213 are unlocked and folded around the first hinges 291. The head support, the upright support and the support frame are stored in parallel relationship.

The locking and unlocking hinges have tightening and loosening bolts and nuts with locking surfaces for engaging and disengaging interengaging locking surfaces.

Benefits of the present invention include a compact, flat folding design, a lightweight alloy construction, and an ergonomic headrest.

While the invention has been described with reference to specific embodiments, modifications and variations of the invention may be constructed without departing from the scope of the invention.

The invention claimed is:

1. A portable headrest for a bed, comprising an under mattress base having an outer end extending from between a mattress and a support structure for the mattress, spaced uprights having upper ends and lower ends, wherein the uprights are adjustable vertically, the lower ends being connected to the outer end of the base, first interconnectors between the lower ends of the uprights and the outer end of the base for rigidly holding the uprights in predetermined normal relative positions for working, and in collapsed parallel positions for storage and carrying, a head support having inner ends connected to the upper ends of the spaced uprights, second interconnectors between the upper ends of the uprights and the inner ends of the head support for rigidly holding the head support in predetermined normal relative working positions with the uprights, and in collapsed parallel positions for storage and carrying, and a padded headrest connected to the head support for resting a head of a user on the headrest away from the mattress.

2. The portable headrest of claim 1, wherein the outer end of the base is hinged to the uprights with locking hinges.

3. The portable headrest of claim 1, wherein the inner ends of the head support are hinged to the upper ends of the uprights with locking hinges.

4. The portable headrest of claim 1, wherein the head support comprises a horseshoe shape.

5. The portable headrest of claim 1, wherein the ends of the uprights further comprise interengaging locking connections.

6. The portable headrest of claim 1, wherein the first and second interconnectors further comprise threaded bolts extending through the ends of the uprights, nuts connected to the bolts and the uprights, and complementary interlocking faces between the uprights and base and headrest for locking the uprights in selected relative normal positions for working or collapsed positions for storing and carrying.

7. The portable headrest of claim 1, wherein the first and second interconnectors further respectively comprise first complementary connections and pivots on the outer end of the base and the lower ends of the uprights, and second complementary connections and pivots on the upper ends of the uprights and the inner ends of the head support.

8. The apparatus of claim 7, wherein the connections are locking hinges for folding the uprights on the base and folding the head support beams on the uprights.

9. The apparatus of claim 7, wherein uprights are telescoping and locking for folding between the head support and the base.

10. A headrest apparatus for a bed, comprising a base for placing between a mattress and a mattress support with an outer end of the base projecting beyond an edge of the mattress, a first hinge connected to the outer end of the frame, an upright support connected to the first hinge for standing upward along a wall of a mattress in an operational position and for lying parallel with the frame in a stored position, a second hinge connected to an upper end of the upright support, and a head support extending outward from the second hinge for extending outward from an upper surface of the mattress in an operational position and for lying parallel with the upright support in a stored position wherein the first and second hinges comprise first spaced apart locking hinges and second spaced apart locking hinges respectively connected to spaced apart members of the frame and the upright support, and connected to spaced apart members of the upright support and the head support, wherein the frame comprises a lightweight horizontal plate, and wherein the spaced apart members of the upright support comprise extensible telescoping tubes connected by the hinges to the outer end of the base and foldable parallel to the base in stored position, and extending normally to the base in working position.

11. The apparatus of claim 10, wherein the locking hinges are connected to the base, the upright support and the head support have interlocking structures for permitting pivoting while the locking hinges are loosened, and preventing pivoting when the locking hinges are tightened.

12. The apparatus of claim 10, wherein the head support comprises parallel ends connected to upper ends of the horizontal members of the upright support, and wherein the head support is foldable on the spaced apart members of the upright support in the stored position.

13. A portable headrest for a bed comprising a base, the base being placed between a mattress and a support structure for the mattress, an end of the base extending from between the mattress and the support structure, spaced parallel supports having upper ends and lower ends, the lower ends of the spaced parallel supports connected to the end of the base, the upper ends of the spaced parallel supports connected to a headrest for resting a head of a user on the headrest away from the mattress, wherein the parallel supports are adjustable vertically, quick release levers for locking the headrest and parallel supports in predetermined normal relative positions for working, and in collapsed parallel positions for storage and carrying.

14. The portable headrest of claim 13, wherein the parallel supports comprise two or more sections for moving relative to one another.

15. The portable headrest of claim 13, wherein the parallel supports are locked relative to one another by locking levers.

16. The portable headrest of claim 13, further comprising a removable aroma therapy oil tray extending outward from the base between the spaced parallel supports and beneath the headrest.

* * * * *